United States Patent [19]

Paurat et al.

[11] Patent Number: 4,695,098

[45] Date of Patent: Sep. 22, 1987

[54] EXCAVATOR, PARTICULARLY FOR CONTINUOUS STRIP MINING OF MINERALS

[76] Inventors: Friedrich W. Paurat, Kasselweg 29, 4230 Wesel 1; Roland Paurat, Blumenstrasse 11, 4230 Wesel 13, both of Fed. Rep. of Germany

[21] Appl. No.: 864,439

[22] Filed: May 16, 1986

[30] Foreign Application Priority Data

May 24, 1985 [DE] Fed. Rep. of Germany ..... 3518691

[51] Int. Cl.[4] ..... E21C 35/20; E21C 37/02

[52] U.S. Cl. ..... 299/64; 299/87; 37/190

[58] Field of Search ..... 299/64, 67, 76, 78, 299/87, 55; 37/57, 108 R, 189, 190

[56] References Cited

U.S. PATENT DOCUMENTS

| | | | |
|---|---|---|---|
| 2,735,667 | 2/1956 | Potvin | 299/67 |
| 3,052,455 | 9/1962 | McLaughlin et al. | 299/64 |
| 3,892,443 | 7/1975 | Arentzen | 299/67 |
| 3,987,564 | 10/1976 | Satterwhite | 299/76 X |
| 4,159,055 | 6/1979 | Eberle | 299/67 X |
| 4,277,105 | 7/1981 | Taylor | 299/64 |
| 4,441,761 | 4/1984 | Fields et al. | 299/64 |
| 4,616,880 | 10/1986 | Nozaki et al. | 299/64 |

*Primary Examiner*—Stephen J. Novosad

*Assistant Examiner*—David J. Bagnell

*Attorney, Agent, or Firm*—Karl F. Ross; Herbert Dubno

[57] ABSTRACT

The excavator for mining minerals, particularly for continuous strip mining of minerals, comprises a track drive, a digging unit with at least one digging roller and a connected conveyor for raw ore formed in the mining operation. The digging roller has a roller core and at least one helical digging and delivery flight. A delivery mechanism is mounted between the conveyor and the digging roller. The delivery mechanism comprises a breaking wedge and a delivery frame with a delivery opening connected to the breaking wedge. The breaking wedge extends from the underside of the delivery frame to the ground, and of course with a breaking surface thereon substantially tangent to the helical digging and delivery flight. There is a gap A between the breaking wedge and the helical digging and delivery flight of thread height H, and the sum of the gap A and the thread height H is less than the width B and the height C of the delivery opening. The conveyor is mounted on the underside of the delivery frame. The helical digging and delivery flight is a breaking tool and has a thread pitch G which is smaller than the width B and the height C of the delivery opening. The digging roller is rotatable in the working direction at the breaking wedge from below to above.

10 Claims, 3 Drawing Figures

EXCAVATOR, PARTICULARLY FOR CONTINUOUS STRIP MINING OF MINERALS

CROSS REFERENCE TO RELATED APPLICATIONS

This application is related to the following applications: Ser. No. 761,571 filed Aug. 1, 1985 and Ser. No. 692,039 filed Jan. 16, 1985, which may have reference to one or more of the following patents: U.S. Pat. Nos. 4,557,373; 4,470,636; 4,499,993; 4,451,089; 4,470,636; 4,278,293; 4,274,675; 4,247,997; 4,173,836; 4,231,618; 4,080,000; 4,096,845; 3,998,493; 3,729,056; 3,297,292; and 3,191,756.

FIELD OF THE INVENTION

Our invention relates to an excavating machine for use in mining operations and, more particularly, to an excavator for the continuous strip mining of minerals.

BACKGROUND OF THE INVENTION

An excavator used for mining minerals, particularly for continuous strip mining of minerals, can comprise a track drive, a digging unit with at least one digging roller and a connected conveyor for the raw ore or broken mineral matter formed in the mining operation. The digging roller has a roller core and at least one helical digging and delivery member or screw or worm flight.

A delivery mechanism which receives raw ore from the helical digging flight is mounted between the conveyor and the digging roller. The digging unit can be movable up and down and can also be pivotable about a vertical axis. Usually two digging rollers are provided which work opposing the delivery mechanism. On the outside of the excavator front end, additional digging rollers angled fordwardly can work with the above mentioned digging rollers.

As noted in the documents earlier referred to, a tunnel or gallery excavator is known. These can be employed only with some difficulty as strip-mining machines. The delivery mechanism comprises a loading apron and digging tool in the form of a digging arm or digging roller. The digging tool also guides the raw ore to the conveyor. When used in strip mining such machines cannot guarantee that the delivered raw ore component will not have a grain size which is too large and exceeds a predetermined minimum grain size. Such oversize pieces lead to an interference or disturbance in the flow of the raw ore, in its manipulation and frequently with its delivery.

OBJECTS OF THE INVENTION

It is an object of our invention to provide an improved excavator for mining minerals, particularly for continous strip mining of minerals.

It is also an object of our invention to provide an improved excavator for mining minerals in which the components of the mined raw ore do not exceed a predetermined minimum grain size.

SUMMARY OF THE INVENTION

These objects and others which will become apparent hereinafter are attained in an excavator for mining minerals comprising a track drive, a digging unit with at least one digging roller and a connected conveyor for the raw ore formed in the mining operation. The digging roller has a roller core and at least one helical digging and delivery member or flight. A delivery mechanism which receives raw ore from the helical digging and delivery flight is positioned between the conveyor and the digging roller.

According to our invention the delivery mechanism comprises a breaking wedge and a vertically dispsosed delivery frame with an advantageously rectangular delivery opening connected to the breaking wedge. The breaking wedge extends from the underside, i.e. the horizontal lower member, of the delivery frame to the ground, and with a breaking surface thereon substantially tangent to the helical digging and delivery flight. There is a gap A between the breaking wedge and the helical digging and delivery flight of thread height H, and the sum of the gap A and the thread height H is less than the width B and the height C of the delivery opening. The conveyor is mounted on the underside of the delivery frame. The helical digging and delivery flight is a helical breaking tool and has a thread pitch or interturn spacing G which is smaller than the width B and the height C of the delivery opening. The digging roller is rotatable in the working direction at the breaking wedge from below to above.

Our invention is based on our discovery that the helical digging and delivery flight together with the roller core can work as a stone breaker or crusher when the suitable complementary device is provided.

This device can be a very simple tool, namely the breaking wedge described above. This store crusher is designed with parameters A, H and G so that a maximum grain size is precisely produced, namely that given by the relationship $(A+H)\times G$. This definite functional relationship is guranteed, because the digging roller during the digging work as it were "undershoots", namely moves from below to above.

This of course, does not prevent these digging rollers from being rotated in the opposite direction when breaking up of stone formed in the mining process is not required.

The maximum grain size according to our invention is smaller than the height and width of the delivery opening so those components of the raw ore which are less than or equal to that grain size are conveyed with high efficiency and of course pieces whose size is larger than that grain size do not reach the conveyor. Components of the raw ore which are thrown against the delivery frame fall down to be broken into smaller pieces.

The delivery frame with the breaking wedge can be movable in a vertical direction and/or the gap A between the delivery frame and said cutting roller can be adjusted.

The connection of the conveyor to the delivery mechanism can be made in a variety of ways. In one embodiment of our invention the conveyor is a belt conveyor and has a guide roller near the under side of the delivery mechanism. Also the helical digging and delivery flight can be provided with auxiliary breaking tools particularly with picks.

BRIEF DESCRIPTION OF THE DRAWING

The above and other objects, features and advantages of our invention will become more readily apparent from the following description, reference being made to the accompanying drawing in which.

SPECIFIC DESCRIPTIONS

Figure 1:
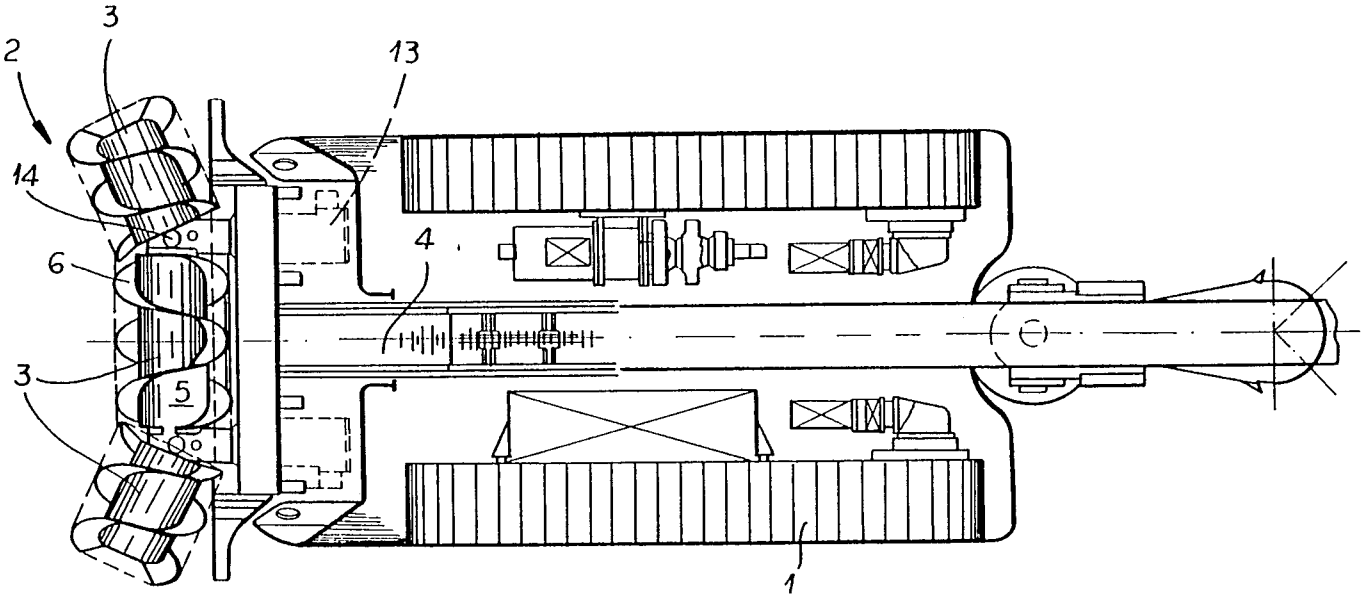
FIG. 1 is a top plan view of an excavator for mining minerals according to our invention.

The apparatus shown in the drawing is an excavator for mining minerals, particularly for strip mining minerals. It comprises basically a track drive 1, a digging unit 2 with a plurality of digging rollers 3 and a connected conveyor 4 for the raw ore.

Figure 2:
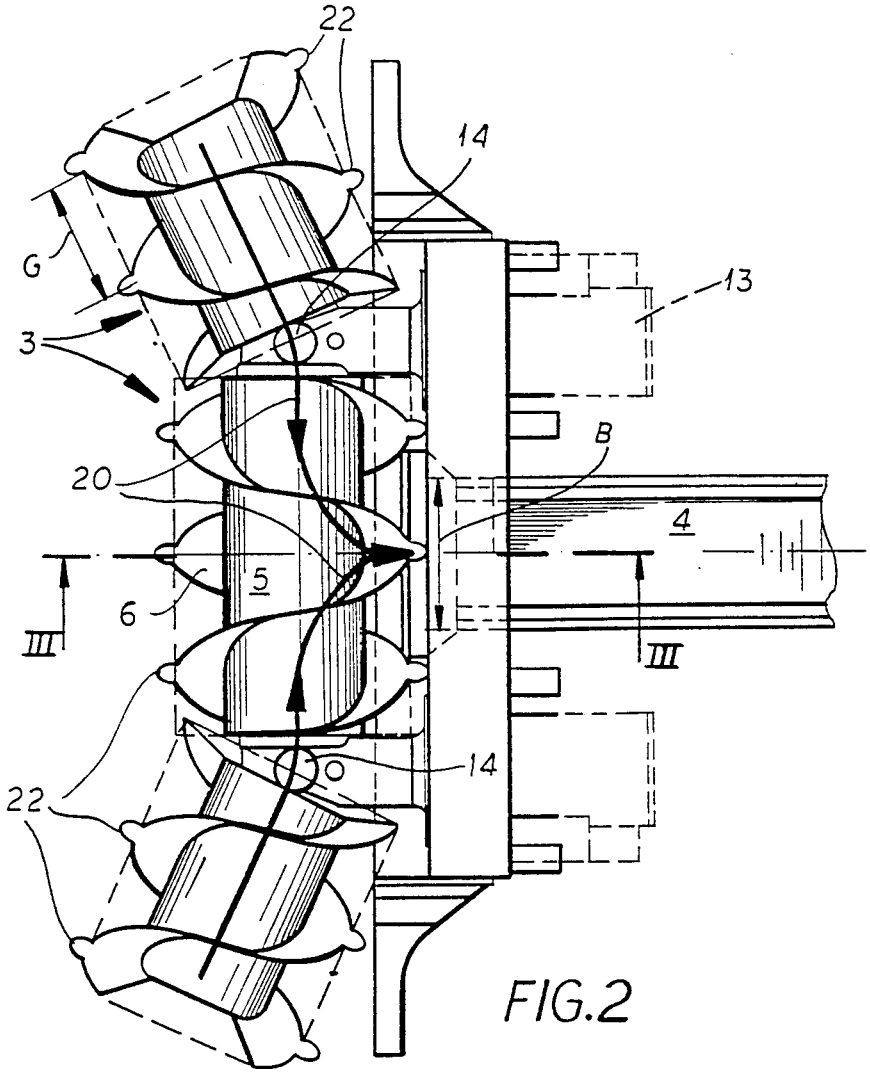
FIG. 2 is a cutaway top plan view to an enlarged scale of the front of the excavator of FIG. 1 showing a digging unit, a delivery mechanism and conveyor.
Figure 3:
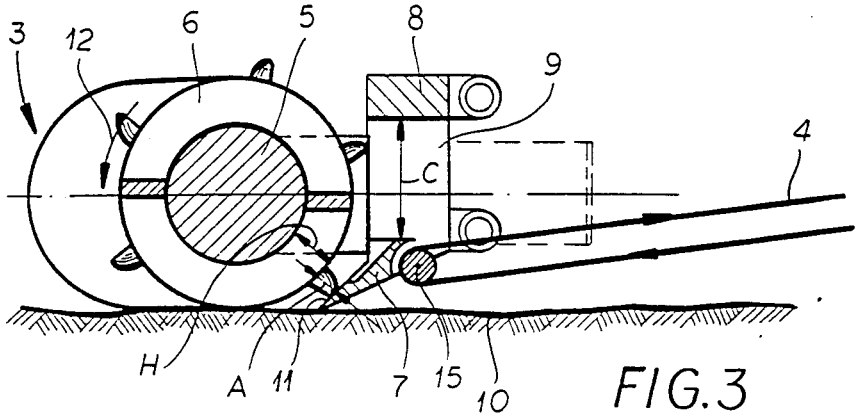
FIG. 3 is a cross sectional view through the apparatus of FIG. 2 taken along the section line III-III.

As is particularly evident from FIG. 3 the digging rollers 3 have a roller core 5 and at least one helical digging and delivery flight 6. A delivery mechanism 7 and 8 is mounted between the digging rollers 3 and the conveyor 4. Usually the structure of the excavator is such that the helical digging and delivery flight 6 feeds the raw ore to the conveyor 4 and of course in the direction of the curved arrow 20 shown in FIG. 2.

FIGS. 2 and 3 show that the delivery mechanism 7 and 8, which extends over the entire width of both central digging rollers 3, comprises a breaking wedge 7 and connected with it a delivery frame 8 with a delivery opening 9.

The breaking wedge 7 extends, as seen form FIG. 3, from the underside of the delivery frame 8 to the ground 10 and of course with its breaking surface 11 substantially tangent to the helical digging and delivery flight 6.

The breaking wedge 7 is spaced with a gap A from the helical digging and delivery flight 6, which has a helical height H.

The sum of the gap width A and the helical height H is smaller than the width B and the height C of the corresponding delivery opening 9.

The helical digging and delivery flight 6 is also a ground breaking or excavating tool. It has a thread pitch G which is smaller than the width B and the height C of the rectangular delivery opening 9.

During mining the digging rollers 3 are rotated according to the shown curved arrows 12, that is, at the breaking wedge 7 from below to above by a hydraulic motor in the rollers 3.

The maximum grain size resulting is given by the relationship: maximum grain size is equal to $(A+H)\times G$.

The delivery frame 8 can be adjusted by moving it with its breaking wedge 7 in a vertical direction and/or by varying the gap A with the digging roller 3. This latter adjustment can be performed by a suitable piston-cylinder arrangement 13 shown with dashed lines in FIG. 2 and mounted on the supporting members 14. The delivery opening 9 is rectangular in this example.

The conveyor 4 is a belt conveyor with a guide roller 15 positioned near the underside of the delivery frame 8. The helical digging and delivery flight 6 can have auxiliary breaking tools mounted on it, particularly picks 22.

We claim:

1. In an excavator for mining minerals, particularly for continuous strip mining of said minerals, comprising a track drive, a digging unit with at least one digging roller and a connected conveyor for removing raw ore, said digging roller having a roller core and at least one helical digging and delivery flight, said excavator further comprising a delivery mechanism positioned between said conveyor and said digging roller, the improvement wherein said delivery mechanism comprises a breaking wedge and a delivery frame, said frame lying in a vertical plane and having a delivery opening connected to said breaking wedge, said breaking wedge extending from the underside of said delivery frame to the ground, said wedge having a breaking surface thereon substantially and continuously tangent to said helical digging and delivery flight when said digging unit is in operation, a gap A existing between said braking wedge and said helical digging and delivery flight of threat height H, and the sum of said gap A and said thread height H being less than the width B and the height C of said delivery opening, wherein said conveyor is mounted on said underside of said delivery frame, said helical digging and delivery flight is a breaking tool and has a thread pitch G which is smaller than said width B and said height C of said delivery opening and said digging roller is rotatable in the working direction at said breaking wedge from below to above.

2. The improvement according to claim 1, further comprising means adjusting said delivery frame with said breaking wedge in a vertical direction.

3. The improvement according to claim 1 wherein said gap A between said delivery frame and said cutting roller is adjustable.

4. The improvement according to claim 1 wherein said delivery opening is rectangular.

5. The improvement according to claim 1 wherein said conveyor is a belt conveyor and has a guide roller mounted near said underside of said delivery frame.

6. The improvement according to claim 1 wherein said helical digging and delivery flight has plurality of auxiliary breaking tools mounted thereon.

7. The improvement according to claim 6 wherein each of said auxiliary breaking tools is a pick.

8. An excavator for mining minerals, particularly for continuous strip mining of said minerals, comprising:

a track drive;

a digging unit with at least one digging roller having a roller core and at least one helical digging and delivery flight;

an associated belt conveyor; and a delivery mechanism positioned between said associated belt conveyor and said digging roller having a breaking wedge and a delivery frame with a rectangular delivery opening, said opening being connected to said breaking wedge, said breaking wedge extending from the underside of said delivery frame to the ground with a breaking surface thereon substantially and continuously tangent to said helical digging and delivery flight when said digging unit is in operation, a gap A existing between said breaking wedge and said helical digging and delivery flight of thread height H, wherein the sum of said gap A and said thread height H is less than the width B and the height C of said rectangullalr delivery opening, and said conveyor is mounted on said underside of said delivery frame, said helical digging and delivery flight is a breaking tool and has a thread pitch G which is smaller than said width B and said height C of said delivery opening and said digging roller is rotatable in the working direction at said breaking wedge from below to above.

9. An excavator according to claim 8 wherein said delivery frame with said breaking wedge is movable in a vertical direction.

10. An excavator according to claim 8 wherein said gap A between said delivery frame and said cutting roller is adjustable.

* * * * *